United States Patent [19]

Jinkins

[11] Patent Number: 4,686,893

[45] Date of Patent: Aug. 18, 1987

[54] COVER ASSEMBLY FOR AN AIR MOVING DEVICE

[76] Inventor: Danny R. Jinkins, 337 Center St., Bryan, Ohio 43506

[21] Appl. No.: 877,388

[22] Filed: Jun. 23, 1986

[51] Int. Cl.[4] ..... F23L 7/00

[52] U.S. Cl. ..... 98/119; 49/478; 49/482; 52/DIG. 4; 98/42.07

[58] Field of Search ..... 98/119, 42.07; 52/98, 52/100, DIG. 4, 663; 49/468, 478, 482; 160/354, 368 G; 220/230; 206/818

[56] References Cited

U.S. PATENT DOCUMENTS

| | | | |
|---|---|---|---|
| 2,722,170 | 11/1955 | Broberg . | |
| 3,102,314 | 9/1963 | Alderfer | 52/DIG. 4 |
| 3,389,665 | 6/1968 | Kauffman | 160/368 G |
| 3,609,934 | 10/1971 | O'Carroll | 52/DIG. 4 |
| 3,831,321 | 8/1984 | Johnson . | |
| 3,894,527 | 7/1975 | Ickes | 49/478 X |
| 4,287,815 | 9/1981 | Henderson . | |
| 4,387,541 | 6/1983 | Boomershine | 52/DIG. 4 |
| 4,409,758 | 10/1983 | Dickerson et al. . | |

FOREIGN PATENT DOCUMENTS

| | | | |
|---|---|---|---|
| 62342 | 4/1982 | Japan | 98/42.07 |

*Primary Examiner*—Albert J. Makay
*Assistant Examiner*—Steven E. Warner
*Attorney, Agent, or Firm*—Harold Weinstein

[57] ABSTRACT

A novel and improved cover assembly for an air moving device such as a fan or air conditioner mounted in a wall or ceiling for drawing air therethrough. To prevent cold air from leaking through the device, the improved cover assembly is detachably connected by magnetic means to the rim of the device. The cover assembly is made of insulating material and has a plurality of recesses or channels formed on the internal side thereof extending in spaced relation to each other from the outer edge of each of the inner recesses so that a wide range of rims can be served by one size cover assembly. Depending on the rim size or shape (rectangular, square or circular) the cover assembly can be "fitted" to any rim in question by removing the excess material at the appropriate line of perforations.

5 Claims, 10 Drawing Figures

FIG. 1
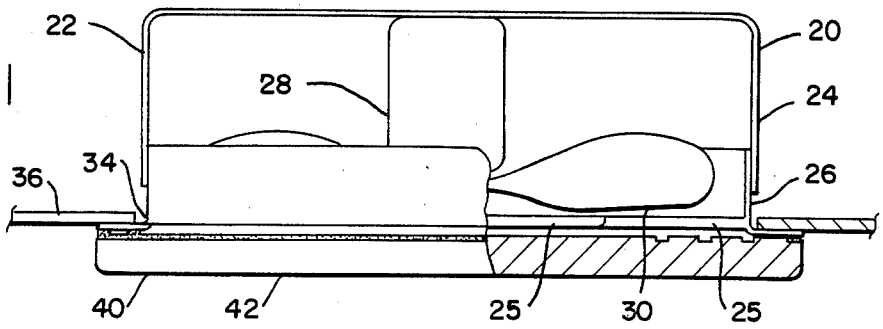
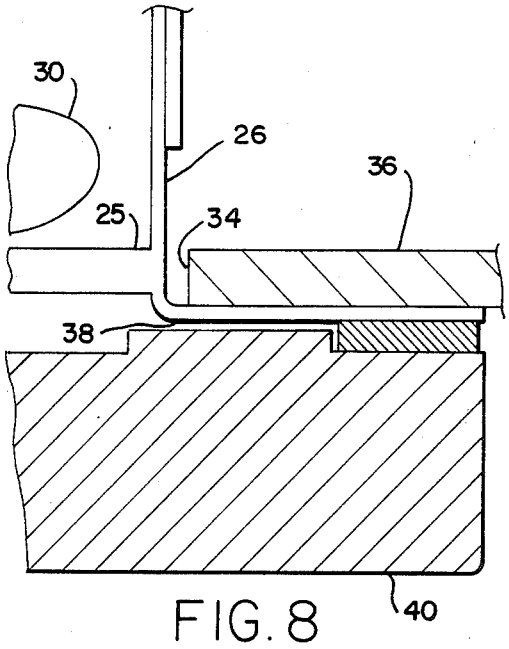
FIG. 8
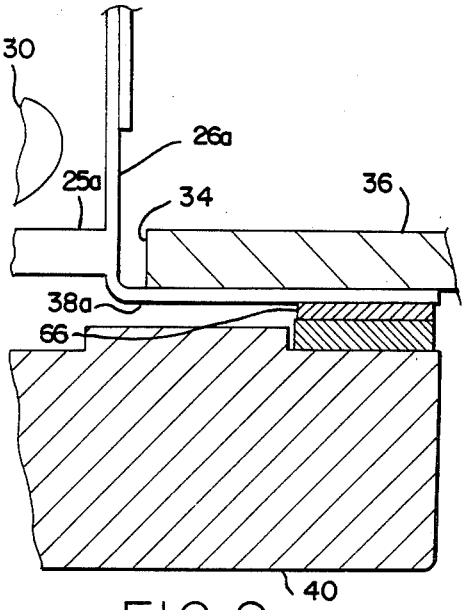
FIG. 9
FIG. 10
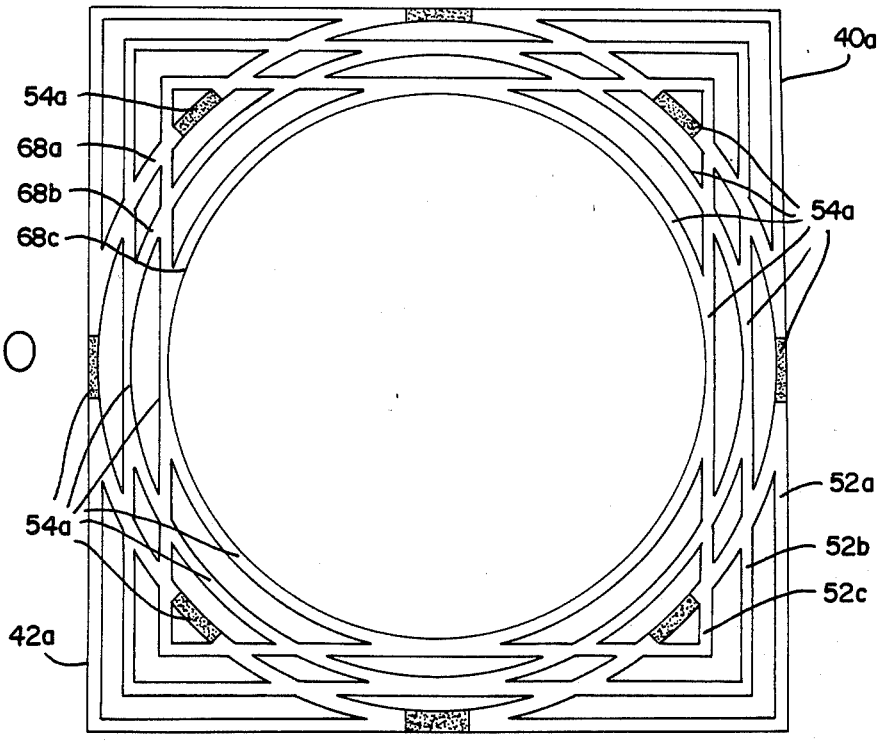

FIG. 4
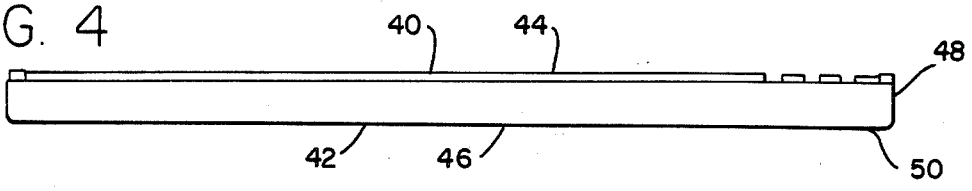
FIG. 5
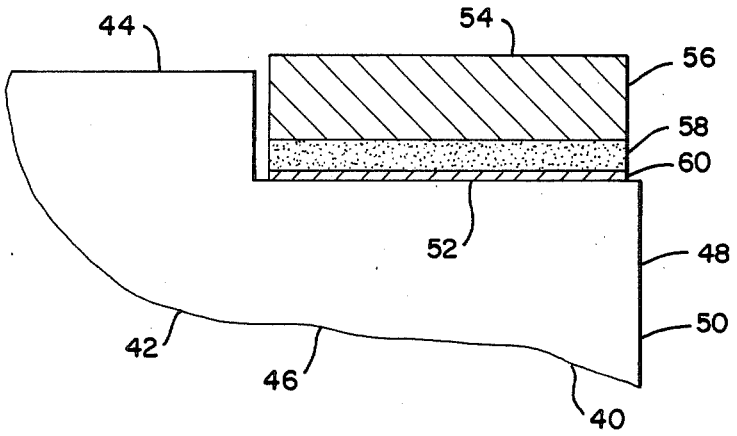
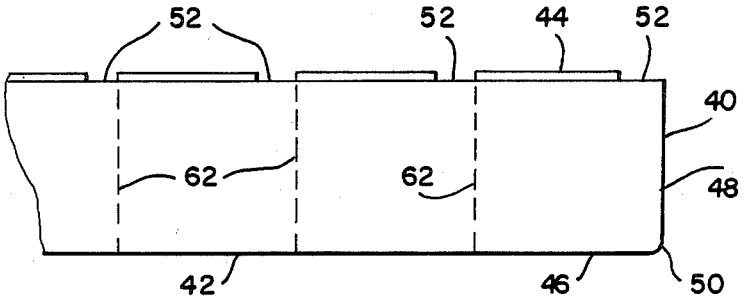
FIG. 6
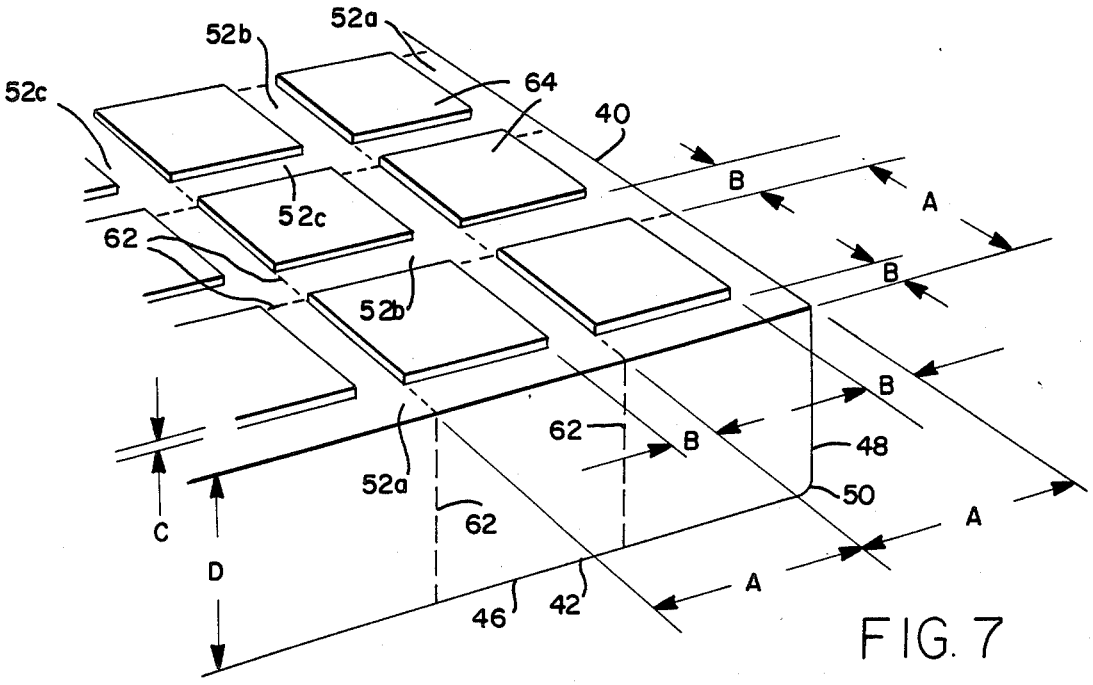
FIG. 7

COVER ASSEMBLY FOR AN AIR MOVING DEVICE

BACKGROUND OF THE INVENTION

The prior art shows various types of removable covers for air moving devices such as fans and the like. However, each cover is made to mate with a corresponding size of fan grill, on a one for one basis. If the fans are of several different sizes, then the covers for such fans also must be made in the same several different sizes, each one of the cover sizes for each one of the same size fans.

SUMMARY OF THE INVENTION

In view of the above, it is a primary object of the present invention, among others, to provide an improved cover assembly for a grill of an air moving device, such as a fan, air conditioner or the like.

It is another object of the present invention to overcome the prior art disadvantages; which is simple, economical and reliable; which uses a single size cover assembly for several grill sizes of air moving devices; which is capable of being easily reduced in size so as to fit a smaller size grill; which is detachably connected to the grill; which uses a magnetic tape so as to be removable from a metal grill; and which can be adjusted to one of a plurality of sizes for a single cover assembly.

Other objects and advantages will be apparent from the following description of several embodiments of the invention and the novel features will be particularly pointed out hereinafter in the claims.

BRIEF DESCRIPTION OF THE DRAWINGS

This invention is illustrated in the accompanying drawings in which:

FIG. 1 is a side elevational view partly in section of a conventional air moving device such as a fan with the improved cover assembly attached to the grill thereof.

FIG. 4 is a side elevational view of the improved cover assembly of FIG. 3.

FIG. 5 is an enlarged view of the edge of the improved cover assembly including the magnetic strip.

FIG. 6 is a side elevational view of the edge of the improved cover assembly including perforations.

FIG. 7 is a perspective of the edge of the improved cover assembly detailing the channels and perforations.

FIG. 8 is an enlarged side elevational view of the invention shown in FIG. 1 showing the cover assembly magnetically connected to the device.

FIG. 9 is another embodiment of the invention of FIG. 8 wherein the rim of the grill has a magnetic material affixed thereto to permit attachment of the cover assembly.

FIG. 10 is another embodiment of the improved cover assembly showing both circular and square channels.

DESCRIPTION OF THE INVENTION

Figure 2:
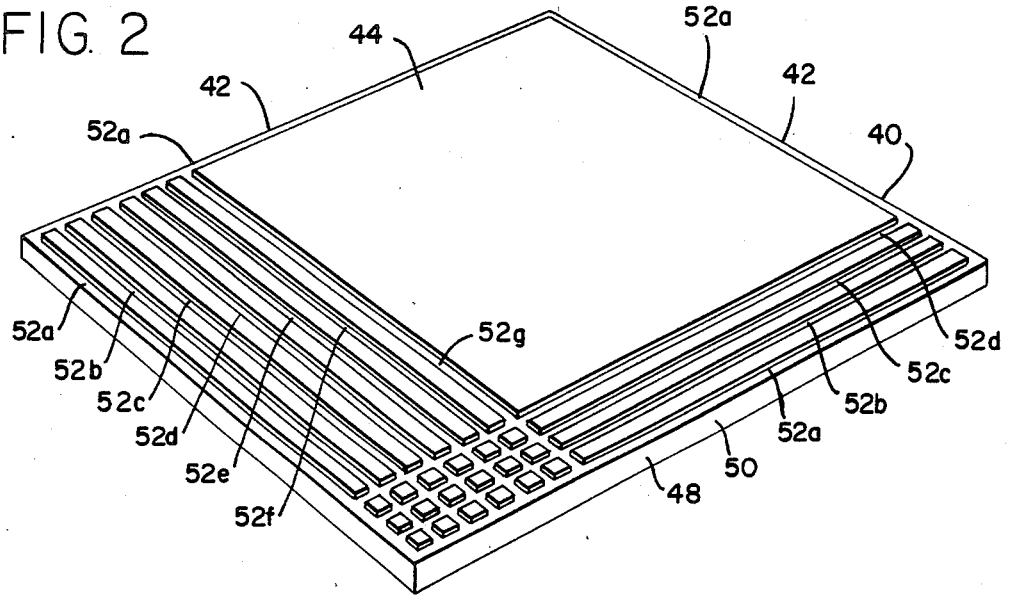
FIG. 2 is a perspective view of the improved cover assembly from the internal side thereof.

In the illustrated embodiment of the invention of FIG. 1 a conventional air moving device 20 is shown in the form of a fan 22 but any other type of air moving device, such as an air conditioner, could have been illustrated as well. The fan 22 has a housing 24 to which a grill 25 having a flanged rim 26 is connected. A motor 28 having blades 30 driven through suitable openings in the housing 24 (not shown) and the grill 25. The grill 25 is connected across the front or room side of the housing 24. The housing 24 is sealingly mounted in an opening 34 of a rigid structural support such as a ceiling or wall 36. The rim 26 of the grill 25 has an outer portion 38 best seen in FIG. 8 which extends beyond the opening 34 a short distance to overlay the wall 36. The rim 26 of the grill is made of a magnetic metal which is magnetically attractive.

Figure 3:
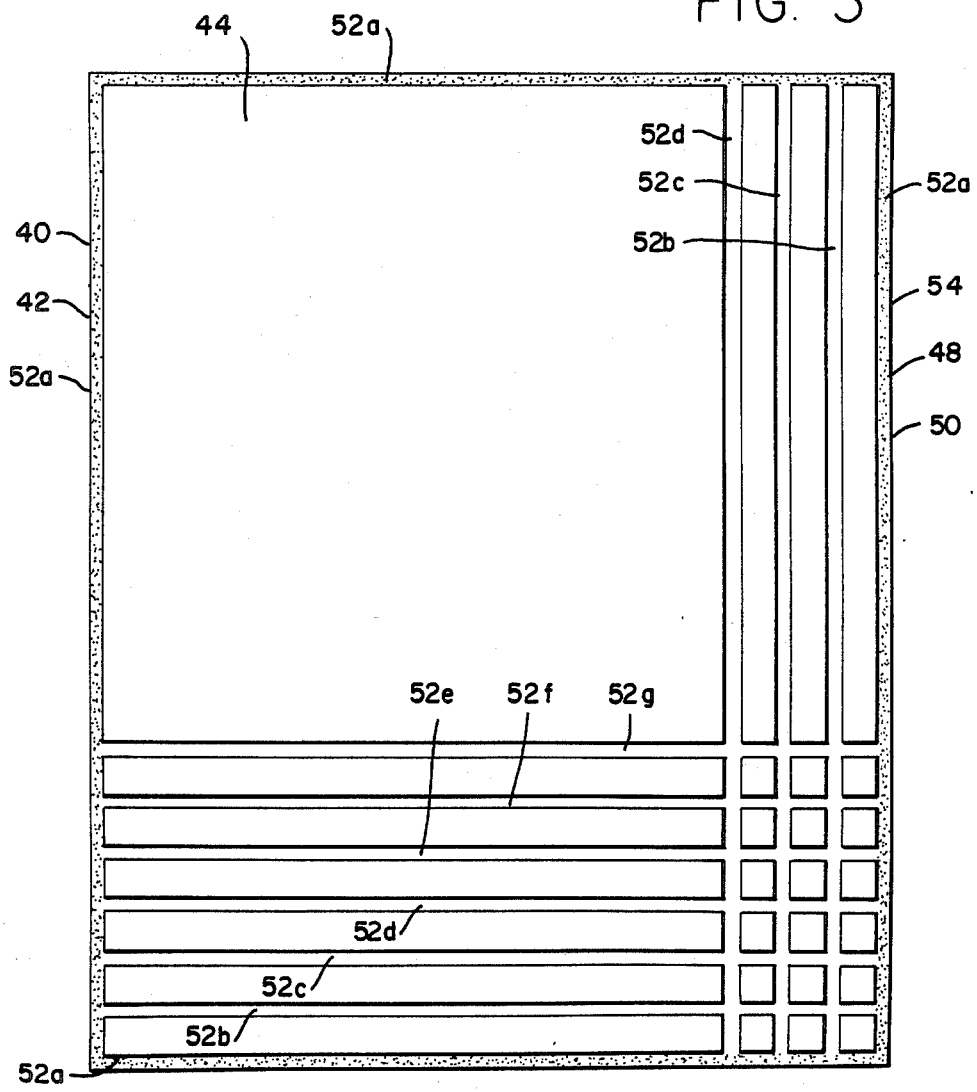
FIG. 3 is a plan view of the improved cover assembly as shown from the internal side thereof.

The improved cover assembly 40 is illustrated in FIGS. 2 through 7. The cover assembly 40 includes a cover 42 made of an insulating material such as a plastic foam or styrofoam and having an internal side 44 which faces the grill 25, an external side 46 facing away from the grill 25 and a periphery 48 defining an outer edge 50. The cover 42 is sized large enough to fit a range of rims 26 of the grills 25 as for example one cover 42 could fit the rims 26 sized from 26″×26″ up to 32″×38″ while another larger size cover 42 could fit the rims 25 sized from 34″×34″ up to 44″×44″. The rim 26 could be any shape such as rectangular, square or circular, with a correspondingly shaped cover 42. A rectangular shaped cover 42 is illustrated in FIGS. 2 and 3. A plurality of recesses or channels 52 are formed on the internal side 44 of the cover 42. Each recess and channel has been given alphabetic suffixes "a", "b", "c", etc. with the peripheral channel generally designated 52*a*, the next inner channel 52*b*, etc. with the most recesses and channels being seven shown in FIG. 2 at 52*g*. An outer recess or channel 52*a* borders the periphery 48. In FIG. 2 the recessed channels 52 and 52*g* are shown for illustration purposes as lines but it is understood though that the recesses and channels 52*a* through 52*g* are formed as recesses with pre-set widths and depths as shown in FIGS. 3, 4, 5, 6 and 7 which width will correspond to the width of the magnetic strips 54 to be affixed in the first channel 52*a*, but the depth thereof is slightly shallower, causing the strips 54 to eXtend above the surface, see FIG. 5. In order to reduce the number of recesses 52 while covering a maximum range of sizes FIG. 3 shows that recesses 52 need only be the multiple for one of a pair of parallel edges. Depending on the size of a respective rim 26 the magnetic strip will always be affixed within the top and left recess 52*a* as viewed in FIG. 3 and only one of the bottom and right recesses 52 that one corresponding to the rim size will be one of a variable size while the remainder of the recesseses at the bottom and right side of the cover 52 will be removed. FIG. 3 shows a rectangular channel 52*a* which has had the magnetic strip 54 affixed therein within the outermost recess 52*a* which is the size corresponding to the rim of a particular size grill 25. Of course had the rim 26 been of a smaller size rectangle or a square another inner recess 52 would have been chosen for receiving the magnetic strip 54 for affixing therein. Note that 52 (and 52*a*) designate both the recess and the channel with the difference being that the recess can refer to mean one or more indentations or legs, while the channel is used to mean one continuous indentation of four legs joined together in the form of a rectangle or square shape which include four recesses 52. The channel 52 is the member into which the magnetic strip 54 will be affixed.

The magnetic strip 54 is illustrated in FIG. 4 and detailed in FIG. 5. A typical strip 54 is shown in the invention but it is understood that any other acceptable magnetic strip could also have been used. The magnetic strip 54 is similar to a ribbon of tape and has a ribbon or strip 56 of magnetic material affixed to a foam backing 58 to which a pressure sensitive tape 60 is adhesively attached with the external side of the tape 60 an adhesive which will be affixed to the channel 52 so as to mount the magnetic strip 54 therein with its upper surface raised slightly above the internal side 44 of the cover 52.

The cover 42 is made of a standard size to fit several grill 25 shapes and sizes. To fit several sizes the cover 42 will be perforated at 62, at the outer end of each of the inner recesses 52*b*, 52*c*, etc. with the perforation 62 extending through the entire depth of the cover 52 from the internal side 44 to the external side 46 as best illustrated in FIGS. 6 and 7 neither of which have included a magnetic strip 54 attached to the cover 52 therein for greater clarity. In FIG. 7 one typical sizing of a cover 52 is depicted in a square format wherein the depth "D" equals 2" and the recesses 52*a*, 52*b* and 52*c* form adjacent squares 64 in which the sides "A" are each equal to 2". The width "B" of the recesses 52 and 52*a* are equal to 0.4", while the depth "C" of the recesses 52 and 52*a* measured from the surface of the internal side downwardly equals 0.10". Each of the perforations 62, which are formed in both horizontal and vertical lines, will be formed adjacent the outermost edge of all the inner recesses 52*b*, 52*c*, etc. as shown in FIG. 7. This means that upon affixing a magnetic strip 54 into one of the inner channels 52, the cover 42 will be made smaller by removing material outwardly of the strip by breaking away such material at the adjacent lines, both horizontal and vertical of perforation 62.

The cover assembly 40 illustrated in FIGS. 1 and 8 is complete and has been installed by being detachably magnetically connected to the outer portion 38 of the rim 26 of the grill 25. If the cover assembly 40 had been originally sized larger than the rim 26 of the grill 25 than either before or after the magnetic strip 54 was affixed to one of the recesses 52, which particular one corresponds to the grill 25 size to cover the same, the excess material was removed from the cover 52 by breaking away any excess material at the appropriate lines of perforation 62 as explained above. During winter or cold weather when the leakage or drafts are most prevalent through the air moving device 20 maximum advantage from use of the cover assembly 40 is obtained. By manually attaching or removing the cover assembly 40 the desired closing or opening at the grill 32 is obtained. The magnetic strip 54 of the cover assembly 40 is pressed against the outer portion 38 of the rim 26 of the grill 25 to provide a continuous seal about the opening of the grill 32. The cover assembly 40 is made of insulating material so that cold leakage or heat loss is virtually eliminated. By simply lifting the cover assembly 40 away from the air moving device 20 it will free the opening of the grill 25 so that the device 20 can be once again operational.

If the device 20 uses a grill 25*a* having a rim 26*a* which is made of non-magnetic material such as aluminum or plastic then its outer portion 38*a* will not accept the cover assembly 40 for securing thereto. A metal or magnetizable tape 66 is adhesively affixed to the outer portion 38*a* substantially all around the border thereof to permit the outer portion 38*a* of FIG. 9 to detachably receive or release the cover assembly 40 in the same way and for the same purposes as the rim 26 of the grill 25 illustrated in FIG. 8.

A second embodiment of the cover assembly characterized as 40*a* is illustrated in FIG. 10. The cover assembly 40*a* includes a cover 42*a* which is similar in all respects to the cover 42 and uses the same reference characters to depict the elements thereof except that the cover 42*a* is square in shape, and also has round recesses or channels 68 with the outer recesses or channels characterized as 68*a* while the next one is depicted as 68*b*, and the next inner recess or channel as 68*c*, respectively. The recesses or channels 52 intersect the recesses or channels 68 in FIG. 10 as at 52*a* and 68*a*, 52*b* and 68*b*, and 52*c* and 68*c*, respectively, but of course either one or the other could be used alone. The magnetic strip 54 is showing in segments 54*a* in the solid line representation in channels 52*a* or 68*a* and in dotted line representation in channels 52*b* or 68*b* and 52*c* or 68*c*. Perforations are not shown in FIG. 10 but they will be the same as that shown in FIGS. 6 and 7 with the addition of perforations being made at the outer edge of the recesses 68*b* and 68*c*. Depending on the grill 25 and rim 26 size and shape the cover assembly 40 or 40*a* will have any excess material removed so as to conform in size and shape to the grill 25 and the rim 26.

Thus, whether the grill 25 or 25*a* is used it can be shaped and sized as desired in the form of a circle, square or rectangle and the cover assembly 40 or 40*a* can be made up to fit a suitably wide range of grill 25 or 25*a* sizes.

It will be understood that various changes in the details, materials, arrangements of parts and operating conditions which have been herein described and illustrated in order to explain the nature of the invention may be made by those skilled in the art within the principles and scope of the invention.

What is claimed for the present invention is:

1. A cover assembly of variable size for an air moving device mounted in the opening of a rigid structural support through which air will be drawn when the device is operated, a grill connected to the device and having a rim thereof of magnetizable material extending over the support, the cover assembly comprising:

(a) a cover made of insulating material and sized to extend beyond the opening of the device by a predetermined amount, (b) the cover having an internal side facing toward the rim of the grill, an external side facing away from the rim of the grill, and a periphery extending about the perimeter between the internal and external sides thereof, (c) the internal side of the cover having a purality of recesses spaced circumferentially inwardly from the periphery of the cover, each in the form of a continuous channel forming a closed loop whereby one of the channels will substantially conform to the size of the rim of the grill, (d) the outermost channel defining the largest cross-sectional area and the innermost channel defining the smallest cross-sectional area, with internal channels there between of intermediate cross-section, (e) a magnetic material in the form of a magnetic strip affixed within the said one of the channels conforming to the size of the rim of the grill whereby the cover assembly is adapted to be magnetically and detachably connected to the rim of the grill and thereby close the opening through the device, and (f) the said one of the channels to which the magnetic strip is affixed to define the perimeter of the cover assembly and any insulating material extending beyond the said one of the channels will be removed.

2. The combination claimed in claim 1 wherein:

(a) a plurality of perforations is formed at the outermost side of each of the inner channels and extends between the internal side and the external side of the cover whereby when the magnetic material is affixed to a channel inwardly from the periphery of the cover the portioh of the cover outwardly of the magnetic material will be separated from the cover via the perforations.

3. The combination claimed in claim 1 wherein:

(a) a metal strip of magnetizable material is affixed to the rim of the device whenever the rim is made of non-magnetic material.

4. The combination claimed in claim 1 wherein:

(a) the outermost channel lies at the periphery of the cover, (b) recesses are formed in one of the pair of parallel sides circumscribing the cover, (c) the recesses are spaced from each other from the periphery inwardly, (d) the perforations are formed at the outer side of the recess except the recess at the periphery, (e) the channel is formed in a continuous closed loop by connecting the first channel with the recesses corresponding to the size of the rim and removing the excess portion of the cover beyond the line of the perforation, and (f) the magnetic strip is affixed to the last mentioned channel.

5. The combination claimed in claim 1 wherein:

(a) the channel having the magnetic strip affixed thereto substantially conforms to the geometric shape of the rim of the grill to which the cover assembly is to be detachably connected.

* * * * *